United States Patent [19]

Gerking et al.

[11] 4,202,855

[45] May 13, 1980

[54] METHOD OF PRODUCING CONTINUOUS MULTIFILAMENT YARNS

[75] Inventors: Lüder Gerking; Dirk Stahlmann; Horst Rothert; Wolf Karasiak, all of Berlin, Fed. Rep. of Germany

[73] Assignee: Karl Fischer, Apparate-und Rohrleitungsbau, Berlin, Fed. Rep. of Germany

[21] Appl. No.: 790,742

[22] Filed: Apr. 25, 1977

[30] Foreign Application Priority Data

Apr. 23, 1976 [DE] Fed. Rep. of Germany ..... 2618406

[51] Int. Cl.[2] ..... D01D 5/12

[52] U.S. Cl. ..... 264/210.2; 19/299; 264/176 F

[58] Field of Search ..... 264/210 F, 176 F; 28/271, 273, 274, 275, 276, 255; 19/299

[56] References Cited

U.S. PATENT DOCUMENTS

| | | | |
|---|---|---|---|
| 3,481,558 | 12/1969 | Davies et al. | 264/210 F |
| 3,706,826 | 12/1972 | Bremner et al. | 264/40.3 |
| 3,802,817 | 4/1974 | Matsuki et al. | 264/210 F |
| 4,035,464 | 7/1977 | Kubitzek et al. | 264/210 F |
| 4,035,883 | 7/1977 | Bond | 264/210 F |
| 4,049,763 | 9/1977 | Mineo et al. | 264/210 F |

FOREIGN PATENT DOCUMENTS

| | | | |
|---|---|---|---|
| 2025109 | 11/1970 | Fed. Rep. of Germany . | |
| 1660489 | 4/1971 | Fed. Rep. of Germany . | |
| 2058690 | 6/1972 | Fed. Rep. of Germany | 264/210 F |
| 43-11824 | 5/1968 | Japan | 264/210 F |
| 45-5057 | 2/1970 | Japan | 264/210 F |
| 47-16714 | 9/1972 | Japan | 264/210 F |
| 47-36225 | 9/1972 | Japan | 264/210 F |
| 51-29513 | 3/1976 | Japan | 264/210 F |

*Primary Examiner*—Jay H. Woo

*Attorney, Agent, or Firm*—Spencer & Kaye

[57] ABSTRACT

A method for producing a multifilament yarn by melt spinning of individual filaments which are grouped together to form yarn, in which, before winding, the yarn is subjected, in addition to the actual removal forces acting from the outside on the yarn, to further forces produced by gas streams which accompany the yarn in its longitudinal direction.

12 Claims, 7 Drawing Figures

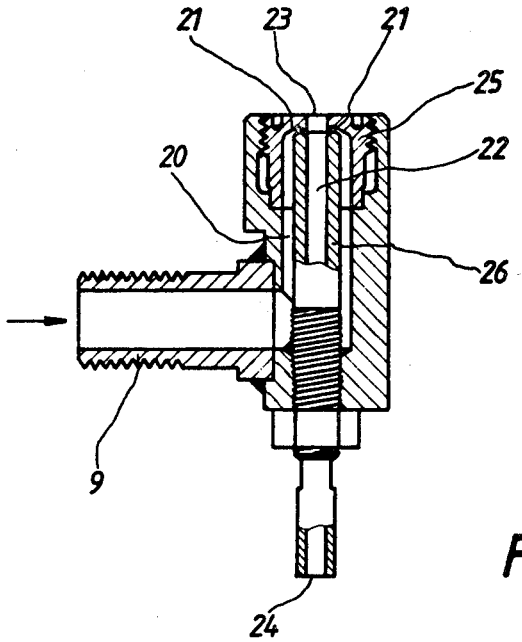
Fig. 5
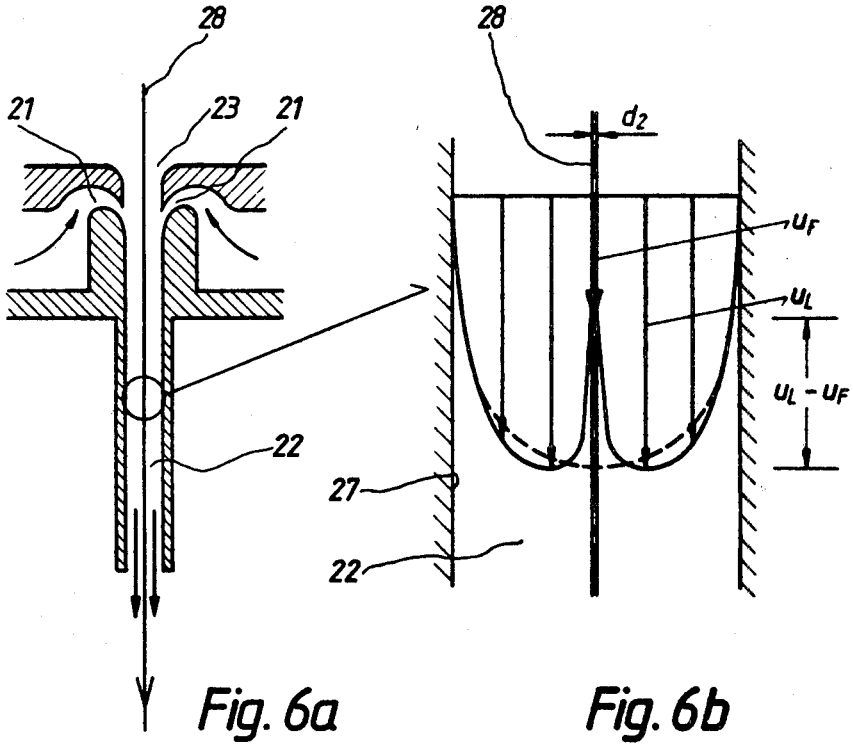
Fig. 6a
Fig. 6b

METHOD OF PRODUCING CONTINUOUS MULTIFILAMENT YARNS

BACKGROUND OF THE INVENTION

The present invention relates to a method for producing multifilament yarns from thermoplastic polymers by spinning individual filaments from a plastic in molten condition, the filaments after being formed in the spinning nozzles of one or more spinning heads and, after issuing from the nozzles, being subjected to subsequent preorientation, solidification, grouping into a multifilament bundle, and preparation during delivery and before being deposited or wound onto bobbins, or further processing.

In a paper entitled "Neues Spinnverfahren zur Herstellung texturierter Garne aus Polyester" [New Spinning Process for Producing Texturized Polyester Yarns] by H. Schätzle, published in Chemiefasern/Textil-Industrie [Chemical Fibers/Textile Industry] in April 1973, at pages 295/296, an overview is given of the developments in this field. In this connection the conventional process, spin stretching, stretch texturizing, and rapid, or stretch, spinning are discussed. Recent developments in the production of polyester yarns have led to the attainment of production speeds of 3,500 to 4,000 m/min, which also constitute the optimum speed for other thermoplastic polymers, such as, for example, polyamide 6.6.

A particular problem presented by such high speeds is that the yarn tension is very much influenced by the drag resistance of the yarn to the surrounding gaseous medium. While with lower production speeds the yarn tension depends substantially only on the delivery force, which is moreover absorbed by guide elements, such as godets for example, care must now be taken that the yarn tension for the greater realizable preorientation at these higher speeds, even without guide elements, will not exceed permissible values for the proper formation of perfect bobbins even if the path between the nozzles and the location of the bobbin or of yarn deposit, respectively, is long.

German Offenlegungsschrift [Laid-Open Application] No. 2,347,801 teaches a technique for winding yarns without godets at speeds of more than 2,500 m/min by grouping the individual filaments into a bundle or bundles beyond the cooling path and for providing them with a preparation coating. Since the outer surface of the yarn thus has much less drag resistance to the surrounding gaseous medium, no undesirably high yarn tension can develop.

German Offenlegungsschrift [Laid-Open Application] No. 2,530,618 discloses a procedure based on the same principle in that the yarn tension is reduced by grouping the filaments into bundles soon after they leave the spinning nozzles and then subjecting the bundles to a preparation treatment.

SUMMARY OF THE INVENTION

It is an object of the present invention to eliminate a number of significant problems created by such high production speeds.

A further object of the invention is to improve the fiber morphological properties and achieve other technological advantages.

These and other objects according to the invention are achieved, basically, by additionally subjecting the yarn defined by a bundle of filaments to further forces, in addition to the actual removal force, which additional forces attack the outside of the yarn and are supplied by longitudinal gas streams which accompany the yarn.

In contradistinction to the previous solutions, where a yarn pulling force must be made available by the winding member so that all tension increasing influences can be compensated, the present invention utilizes the resistance between yarns and their surrounding medium to reduce the force requirement at the winding member. With the gas streams acting on the yarns, the yarn tension values can be set independently of the actual pulling force.

The individual filaments freshly spun from the molten plastic can maintain their orientation, which determines their final strength, only as long as they are not hardened, i.e. as long as a reduction in cross section and thus an increase in speed occurs during delivery from the spinning nozzles. The desideratum is, therefore, to have sufficiently high yarn tensions become effective as closely below the nozzles as possible. If the yarn were to travel at high speed through a quiescent gaseous medium, the pulling force provided by the winding device must not only produce the shaping work but must also overcome the resulting drag resistance. Since the pulling force must be low in order to assure a perfectly structured bobbin, not much force is left for the shaping work when there exists a considerable drag resistance. The known reduction of the drag resistance by early bundling and preparation still limits the yarn tension available for preorientation to the maximum permissible values for winding.

As a result of the present invention, the freshly spun filaments can now be tensioned more strongly at a short distance from the spinning nozzles by forces which act against the outside of the yarn in addition to the actual removal force, without anywhere exceeding the permissible values. The force determining the yarn tension, which is a result of the actual pulling force, inertial forces, gravity and particularly the braking force, can be set merely by reducing the braking force, as desired, practically at any point, by regulating the difference between the yarn speed and the speed of the surrounding gaseous medium. With the prior art measures in quiescent ambient air this difference in speed is equal to the yarn speed.

Depending on the direction and magnitude of the speed of the surrounding gaseous medium, and without influencing the coefficient of friction, the "braking force" can be used to accelerate a yarn, and that is the major feature of the invention, as well as decelerate it.

If, for example, the gas streams which accompany a yarn are produced as a tubular stream having a parabolic velocity profile, then the gas streams act to combine and group the filaments into bundles. This grouping is practically independent of the forces which attack the filaments through the gas streams, which themselves, however, are of substantial influence can the degree of preorientation.

The gas streams used in the present invention cannot be compared with those disclosed, for example, in U.S. Pat. No. 2,604,667, issued on July 29, 1952, which discloses, for example, an air-driven injector nozzle for removing the yarn. Thus the force involved there is merely the actual removal force. The filaments drawn, for example, by means of injector nozzles are not wound but are deposited in a more or less orderly manner. Removal speeds of about 5,000 m/min up to an upper limit of almost 6,000 m/min for melt-extruded polyester yarns are supposed to be achievable. For the removal of thermoplastic yarns, nozzles are also used to produce spun fleece, but there too serve only to produce the actual removal force.

In embodiments of the present invention, a greater number of such accompanying gas streams may be provided over the further path of the yarn, depending on the length of the path to be covered. This measure is of particular significance, for example, when the invention is to be introduced into existing synthetic fiber factories having given distances between the spinning and winding devices. When new systems are planned and equipped, these distances can be kept substantially smaller so that, for example, buildings of one story less may be required.

The pipes delimiting the accompanying gas streams may have any desired cross-sectional shapes. Injector nozzles with a circular, annular cross section have been found to be of particular advantage. Such a nozzle can be formed so that the filaments pass therethrough in the axial direction and the accompanying gas stream is introduced at an acute angle or parallel to the longitudinal axis of the filaments below the yarn entrance opening defined by such nozzle. Other advantageous cross-sectional shapes are represented by triangular, square or rectangular configurations.

There also exists the possibility, in particular, to introduce the accompanying gas stream through a horizontal, slitted nozzle in a vertical wall so that the gas stream is delimited only by this one wall. This practically constitutes a half channel in which the gas stream is introduced in an obliquely downward direction so as to soon become parallel to the walls. A velocity maximum of the gas stream occurs at a slight distance from the wall. The filaments are then combined, or bundled, only by displacement in a direction perpendicular to the wall.

A further advantage of the invention is the possibility of adjusting the speed of the accompanying gas streams in a simple manner by varying the quantity of gas introduced. This permits variations in the resulting yarn tension to almost any degree. It is also possible, in this connection, to reverse the direction of the gas streams so that they flow counter to the longitudinal direction of the delivered yarn. This offers the possibility of reducing the yarn tension above the gas injector nozzle and increasing it correspondingly below the nozzle.

The gas forming the accompanying gas stream can be conditioned at not much additional expense, e.g. heated or cooled, dried or humidified, so that the morphological properties of the resulting yarn can be easily and effectively influenced. In practice, air is used advantageously as the gaseous medium. The conventional solidification in a transversely flowing stream of air can here be maintained in principle.

The essential significance of the present invention is the possibility of winding the resulting yarn without difficulties without employing godets at speeds of more than 2,500 m/min. The bobbins wound with the yarn must be properly wound so that they can be processed further, and such proper winding is not assured if the yarn tension or the pulling force, respectively, is too great and, moreover, does not remain constant. By means of the forces produced by the accompanying gas streams to attack at the outside of the yarn, according to the invention, the conditions for proper winding are met.

In practice the present invention results in an additional advantage in that the preparation device can remain in the story of the winding devices, that is no further operating story is required between a spinning and winding device. This is of particular significance in the computation of labor costs because the preparation device can be operated by the personnel who are already always present in the winding room.

BRIEF DESCRIPTION OF THE DRAWINGS

FIG. 5 is a side view in cross-section of an embodiment of an injector device.

FIGS. 6*a*, 6*b* show schematically the orientation and the parabolic velocity profile of the gas stream within the injector device.

In all Figures, corresponding structures and features are identified by the same reference numerals.

DESCRIPTION OF THE PREFERRED EMBODIMENTS

Figure 1:
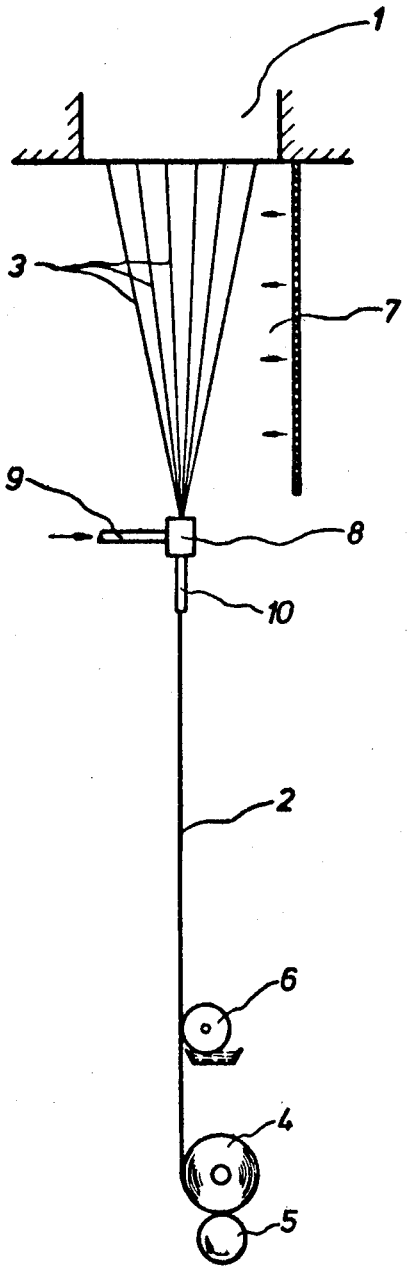
FIG. 1 is a simplified pictorial side view of a device operating according to a preferred embodiment of the invention without godets, of melt-spun filaments with a tubular gas injector nozzle.

The system shown in FIG. 1 includes a melt-spinning unit 1 composed of a spinning head provided with a plurality of spinning nozzles from which filaments 3 which have not yet solidified first enter a blow shaft 7 in which they are attacked by a stream of cooling air flowing substantially in a direction transverse to the longitudinal direction of the filaments. Due to the pulling forces acting on the filaments, a preorientation takes place in shaft 7 during filament solidification. Then the filaments are subjected to the gas stream which constitutes a significant feature of the present invention.

For this purpose, there is provided an injector nozzle 8 having an outlet which opens into a pipe 10 that is closed on all sides. A short distance below the upper filament entrance opening of nozzle 8, or pipe 10, the gas is introduced via a gas inlet 9 so that, as a result of the friction, or drag, resistance of the filaments with respect to the surrounding medium, a force in addition to the actual delivery force is exerted against the outsides of the filaments. The stream of gas which accompanies the yarn in its longitudinal direction thus produces an increase in the tension in the filaments 3 at some section point above the injector nozzle compared to another section point below the nozzle in the combined, bundled yarn 2 on its way to the winding device. Depending on the length of the path traversed by yarn 2 until it is wound onto a bobbin 4 which is driven by a friction roller 5, other such injector nozzles 8 may be provided to adjust the permissible yarn tension.

The preparation of the yarn 2 is effected directly before winding, i.e. in a story of operation in which the winding device is located. For example, a rotating preparation pad 6 as illustrated, which receives a suitable treatment fluid from a reservoir below it, serves for this purpose.

As already mentioned above, the injector nozzles 8 may not only have a circular, but also a polygonal e.g., rectangular cross section.

Figure 2:
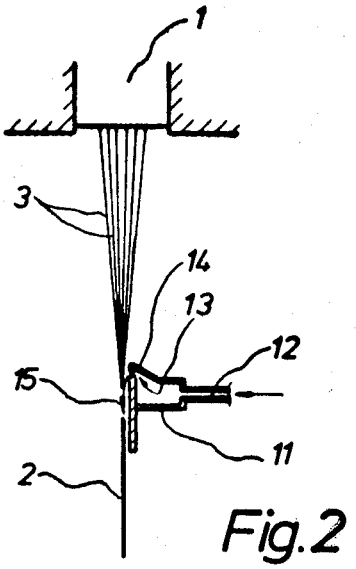
FIG. 2 is a view similar to that of FIG. 1 of the upper portion of a comparable device with a slit-shaped gas injector nozzle.
Figure 3:
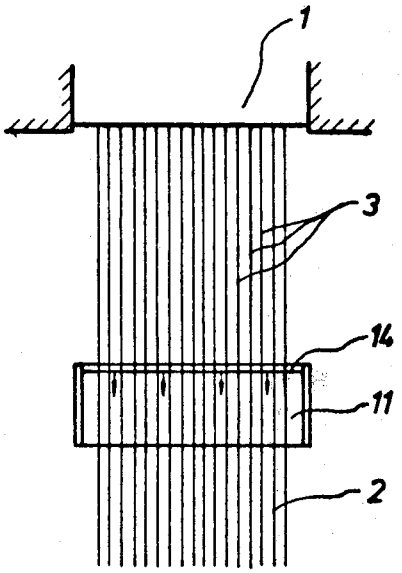
FIG. 3 is a front view of the structure shown in FIG. 2.

FIGS. 2 and 3 differ from FIG. 1 in that they illustrate a gas injector nozzle 11 constituting one half of a channel, i.e., the gas stream is essentially limited to only one side. In this case, the gas travels through a gas inlet 12 and a distributor channel or plenum, 13 and then flows via an elongate slit 14 against the filaments 3 which are thus combined. It has been found that this takes place in a direction perpendicular to the wall delimiting the gas stream. After such combination the filaments are delivered as a flat multifilament band 2. The stream of gas leaving slit 14 is initially oriented downwardly at an acute angle to the direction of filament travel in the direction of arrow 15. However, a velocity profile forms which has its maximum at a slight distance from the delimiting wall surface defined by nozzle 11 so that there are practically only flow components which accompany the yarn in the longitudinal direction.

Figure 4:
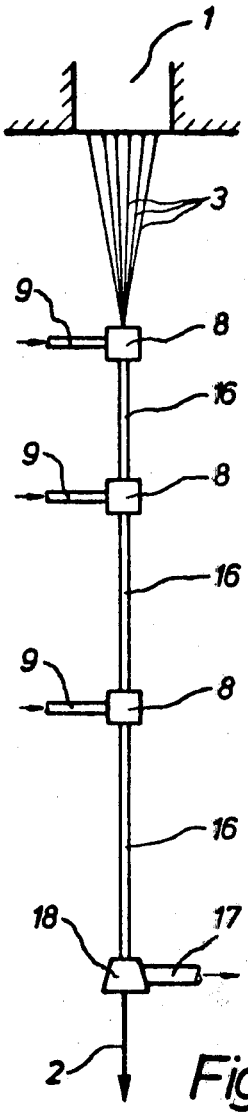
FIG. 4 is a view similar to that of FIG. 1 of a device operating according to the invention with a tubular spinning shaft and a plurality of gas injector nozzles.

In the embodiment shown in FIG. 4, the freshly extruded filaments 3 pass through a first injector nozzle 8 having a circular annular cross section and then pass, as a combined yarn 2, through a hollow tubular spinning shaft 16. Here a parabolic velocity profile forms in the accompanying gas stream which is delimited on all sides by the spinning shaft 16. By means of further injector nozzles 8 of the same configuration as the upper one, the yarn 2 is additionally accelerated inside the spinning shaft 16.

At the lower end of the spinning shaft 16, a chamber 18 may be provided at which part of the accompanying gas stream or the entire gas stream is extracted through an outlet 17. This prevents the gas stream coming out of spinning shaft 16 from impinging on succeeding preparation devices, where it could exert an adverse influence. The spinning shaft 16 may be heatable in order to prevent the condensation of moisture along its inner walls.

The medium for the gas streams is mainly air which, depending on the desired fiber characteristics, may be heated or cooled and/or humidified or dried.

EXAMPLE 1

Unmatted polyethylene terephthalate with an intrinsic viscosity of 0.62, measured in phenol tretrachlorethane, 1:1 at 25° C., and a temperature when molten of 282° C., was melt-extruded into filaments, of 50 dtex F 16 trilobal.

To produce the accompanying gas streams, an injector nozzle having the form shown in FIG. 1 was used which had an inner diameter of 3.4 mm. This nozzle was spaced at a distance of about 1,000 mm below the spinning nozzles. The distance could be varied between about 500 mm and 1,500 mm. Air at room temperature and with a relative humidity of 35% was blown in through the injector nozzle in quantities of 1,500 $dm^3/h$, which with the above-mentioned diameter, created an average speed of about 45 m/sec, which corresponds to 2,700 m/min.

The filaments were cooled in a blow chamber 7 having blowing surface dimensions of 80×1000 mm, with air at room temperature and flowing at a velocity of 0.5 m/sec. The winding speed was set to 3,000 m/min. Below the spinning shaft, which had a length of 4,500 mm, and above the winding device 4 the preparation device 6 was disposed at a distance of 1,000 mm from the axis of the bobbin being wound on the winding device.

A total of six measurements were made with the above data. A value of 10±1 p (p=pond) resulted for the pulling force at the bobbin. The Uster value for the uniformity of the yarn was about ≦0.5%. The test instrument was an Uster Model C.

COMPARISON TEST

Six measurements were made per hour under the same conditions but without the accompanying stream of air from nozzle 8. The values for the pulling forces at the yarn bobbin were about 35 p whereas the yarn uniformity (Uster value) remained about 0.5%.

EXAMPLE 2

Under the same conditions as in Example 1 but with a reduced velocity of 0.3 m/sec for the transversly blown air in chamber 7, five measurements per hour resulted in the yarn pulling force of 10±1 p. The yarn uniformity was ≦0.55%.

These experiments show that the accompanying gas streams substantially reduce the amount of cooling air, 700 to 1,500 $Nm^3/h$ having been heretofore required per spinning location, and in a borderline case this can be completely eliminated so that cooling air is required only in the quantity required to be fed into the injector nozzle. In this borderline case the amount of cooling air was 4·0.15=0.6 $Nm^3/h$. The bundling of the delivered yarn in the accompanying gas stream is effected in particular because the gas acts as air cushions or as a supporting stream which keeps the yarn taut. Other mechanical yarn guides can thus be eliminated. If the walls of the injector nozzles are heated, condensation phenomena can be avoided.

FIG. 5 shows an embodiment of an injector nozzle according to the invention. A gas stream, preferably air, is fed through pipe 9 into the nozzle and flows via annular channel 20 through annular slot 21 with a downward velocity component into the circular channel 22. By injector effect ambient air is sucked-in through circular opening 23. The mixing of both, ambient air and supply air, takes place underneath the slot. The gas or air stream leaves channel 22 through the downward opening 24. As may be seen, the slot width may be adjusted by means of a screw of the upper part 25 and the inner part 26 which contains the channel 22.

The filaments enter the injector nozzle by opening 23 and are pulled by the flow within channel 22 and exit at opening 24. Thus a drawing force is exerted on them by aerodynamic means.

The orientation and the parabolic velocity profile of the gas stream within channel 23 is schematically shown in FIG. 6*a* and 6*b*. The filament with diameter $d_2$ or a bundle of filaments 28, accordingly, runs in the middle of the channel 22 at a velocity $\mu_F$. By virtue of boundary conditions at solid walls the gas stream adheres to the wall 27 and to the moving filament or filament bundle, respectively. Thus an axially symmetrical flow field is formed as shown in FIG. 6*b*. Without filaments the maximum of the parabolic velocity profile would be in the center line of channel 22. With filaments the maximum gas or air velocity $\mu_L$ lies near the filaments, a little outward from the center line.

It will be understood that the above description of the present invention is susceptible to various modifications, changes and adaptations, and the same are intended to be comprehended within the meaning and range of equivalents of the appended claims.

What is claimed is:

1. In a method for producing a multifilament bundle of a plurality of continuous individual filaments of thermoplastic polymers by extruding the polymer in molten form into individual filaments, subjecting the filaments to a removal force to withdraw them from the extrusion location while subjecting the filaments to the steps of preorienting and solidifying the extruded filaments, combining the solidified filaments into a bundle, subjecting the resulting bundle to a preparation treatment, and conducting the bundle, subsequent to the preparation treatment, to a collecting location at which the removal force is applied, the improvement comprising causing a stream of gas flowing in a direction having a component parallel to the length, and extending in the direction of travel, of the filaments to contact the filaments subsequent to solidfication thereof in a region where the filaments are subject to the removal force for subjecting the filaments to a further force in the direction of their length, which further force determines the tension imposed on the filaments during the step of preorienting.

2. Method as defined in claim 1 wherein the stream of gas has a tubular form and surrounds the filaments.

3. Method as defined in claim 2 further comprising varying the quantity of gas delivered to the stream in order to adjust the speed of the gas stream.

4. Method as defined in claim 3 comprising the preliminary step of conditioning the gas forming the gas stream prior to said step of causing.

5. Method as defined in claim 4 wherein gas forming the stream is constituted by air.

6. Method as defined in claim 5 further comprising winding the bundle on a bobbin at the collecting location without the use of godets at a speed in excess of 2,500 m/min.

7. A method as defined in claim 1 further comprising varying the quantity of gas delivered to the stream in order to adjust the speed of the gas stream.

8. A method as defined in claim 1 comprising the preliminary step of conditioning the gas forming the gas stream prior to said step of causing.

9. A method as defined in claim 1 wherein gas forming the stream is constituted by air.

10. A method as defined in claim 1 further comprising winding the bundle on a bobbin at the collecting location without the use of godets at a speed in excess of 2,500 m/min.

11. A method as defined in claim 1 wherein the stream of gas is caused to contact the filaments at a point where they are combined into a bundle.

12. A method as defined in claim 11 wherein said step of combining is effected by the action of the stream of gas on the filaments.

* * * * *